US008469750B2

(12) United States Patent
Chen

(10) Patent No.: US 8,469,750 B2
(45) Date of Patent: Jun. 25, 2013

(54) LED LAMP ASSEMBLY AND LIGHT STRINGS INCLUDING A LAMP ASSEMBLY

(75) Inventor: Johnny Chen, Sindian (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 13/240,628

(22) Filed: Sep. 22, 2011

(65) Prior Publication Data

US 2013/0078847 A1 Mar. 28, 2013

(51) Int. Cl.
*H01R 4/24* (2006.01)

(52) U.S. Cl.
USPC ..... 439/699.2; 362/654

(58) Field of Classification Search
USPC ..... 439/699.2, 419, 619, 425; 362/654, 362/249, 226
See application file for complete search history.

(56) References Cited

U.S. PATENT DOCUMENTS

| | | | | |
|---|---|---|---|---|
| 2,570,751 | A | | 10/1951 | Benander |
| 2,636,069 | A | | 4/1953 | Gilbert |
| 3,233,207 | A | | 2/1966 | Ahroni et al. |
| 3,728,787 | A | | 4/1973 | McDonough |
| 4,045,868 | A | | 9/1977 | Ammon et al. |
| 4,631,650 | A | | 12/1986 | Ahroni |
| 4,712,299 | A | | 12/1987 | Loewen et al. |
| 4,777,573 | A | | 10/1988 | Liao |
| 4,779,177 | A | | 10/1988 | Ahroni |
| 4,807,098 | A | | 2/1989 | Ahroni |
| 4,870,753 | A | | 10/1989 | Pfeffer et al. |
| 4,899,266 | A | | 2/1990 | Ahroni |
| 4,908,743 | A | | 3/1990 | Miller |
| 4,934,964 | A | | 6/1990 | Mazelle |
| 5,051,877 | A | | 9/1991 | Liao |
| 5,073,132 | A | | 12/1991 | Nottrott |
| 5,109,324 | A | * | 4/1992 | Ahroni ..... 362/249.01 |
| 5,121,310 | A | * | 6/1992 | Ahroni ..... 362/238 |
| 5,217,382 | A | | 6/1993 | Sparks |
| 5,218,233 | A | | 6/1993 | Takahashi |
| 5,350,315 | A | | 9/1994 | Cheng et al. |

(Continued)

FOREIGN PATENT DOCUMENTS

| | | |
|---|---|---|
| CN | 201187701 | 1/2009 |
| EP | 0 552 741 A2 | 7/1993 |

(Continued)

OTHER PUBLICATIONS

Office Action for U.S. Appl. No. 13/115,585, filed May 25, 2011. Inventor: Johnny Chen.

(Continued)

*Primary Examiner* — Gary F. Paumen
(74) *Attorney, Agent, or Firm* — Christensen Fonder P.A.

(57) ABSTRACT

An LED lamp assembly including an LED lamp and an LED insert having a body defining two coupler passages extending therethough from a top to a bottom thereof. Two conductive piercing couplers are engaged in one of the two coupler passages. The LED insert is engaged in an upper housing and the upper housing is coupled to a lower housing. The lower housing presents a wire receiving space structured and positioned to be aligned with the insulation piercing wire engaging portion of the two conductive piercing couplers when the upper housing is secured to the lower housing. The two leads of the LED lamp are positioned each in one of the two coupler passages in secure electrically conductive and mechanical contact with one of the spring contact portions of the two conductive piercing couplers.

26 Claims, 14 Drawing Sheets

U.S. PATENT DOCUMENTS

| | | | | |
|---|---|---|---|---|
| 5,366,386 | A | 11/1994 | Liao | |
| 5,380,215 | A | 1/1995 | Huang | |
| 5,389,008 | A | 2/1995 | Cheng et al. | |
| 5,559,681 | A | 9/1996 | Duarte | |
| 5,607,328 | A | 3/1997 | Joly | |
| 5,624,283 | A | 4/1997 | Hotea | |
| 5,626,419 | A | 5/1997 | Lin | |
| 5,653,616 | A | 8/1997 | Hotea | |
| 5,702,268 | A * | 12/1997 | Lien et al. | 439/419 |
| 5,822,855 | A | 10/1998 | Szczesny et al. | |
| 5,829,865 | A * | 11/1998 | Ahroni | 362/657 |
| 5,966,393 | A | 10/1999 | Hide et al. | |
| 6,079,848 | A | 6/2000 | Ahroni | |
| 6,095,874 | A | 8/2000 | Quaranta | |
| 6,120,312 | A | 9/2000 | Shu | |
| 6,139,376 | A | 10/2000 | Ooya et al. | |
| 6,147,367 | A | 11/2000 | Yang et al. | |
| 6,257,736 | B1 | 7/2001 | Fehrenbach | |
| 6,261,119 | B1 | 7/2001 | Green | |
| 6,328,593 | B1 * | 12/2001 | Chang et al. | 439/419 |
| 6,363,607 | B1 | 4/2002 | Chen et al. | |
| 6,407,411 | B1 | 6/2002 | Wojnarowski et al. | |
| 6,452,317 | B1 | 9/2002 | Tseng | |
| 6,533,437 | B1 | 3/2003 | Ahroni | |
| 6,609,814 | B2 | 8/2003 | Ahroni | |
| 6,666,734 | B2 | 12/2003 | Fukatsu | |
| 6,830,358 | B2 | 12/2004 | Allen | |
| 7,066,628 | B2 | 6/2006 | Allen | |
| 7,137,854 | B2 | 11/2006 | Casses et al. | |
| 7,140,928 | B1 | 11/2006 | Jacques et al. | |
| 7,220,022 | B2 | 5/2007 | Allen et al. | |
| 7,226,323 | B2 | 6/2007 | Noro et al. | |
| 7,422,489 | B1 * | 9/2008 | Tseng | 439/699.2 |
| 7,575,362 | B1 | 8/2009 | Hsu | |
| 2002/0109989 | A1 | 8/2002 | Chuang | |
| 2003/0096542 | A1 | 5/2003 | Kojima | |
| 2003/0142494 | A1 | 7/2003 | Ahroni | |
| 2004/0004435 | A1 | 1/2004 | Hsu | |
| 2004/0115984 | A1 * | 6/2004 | Rudy et al. | 439/405 |
| 2008/0007951 | A1 | 1/2008 | Chan | |
| 2008/0186731 | A1 | 8/2008 | Graham | |
| 2008/0205020 | A1 | 8/2008 | Vich | |
| 2008/0307646 | A1 | 12/2008 | Zaderej et al. | |
| 2009/0002991 | A1 | 1/2009 | Huang | |
| 2011/0215368 | A1 | 9/2011 | Chen | |
| 2011/0286223 | A1 | 11/2011 | Chen | |
| 2011/0303939 | A1 | 12/2011 | Chen | |
| 2011/0305022 | A1 | 12/2011 | Chen | |

FOREIGN PATENT DOCUMENTS

| | | |
|---|---|---|
| EP | 0 727 842 A2 | 8/1996 |
| GB | 1150390 | 4/1969 |
| GB | 1245214 | 9/1971 |
| WO | WO 91/10093 | 7/1991 |
| WO | WO 96/24966 | 8/1996 |
| WO | WO 2009/115860 | 9/2009 |

OTHER PUBLICATIONS

File History for U.S. Appl. No. 13/042,171, filed Mar. 7, 2011. Inventor: Johnny Chen.

File History for U.S. Appl. No. 13/115,373, filed May 25, 2011. Inventor: Johnny Chen.

* cited by examiner

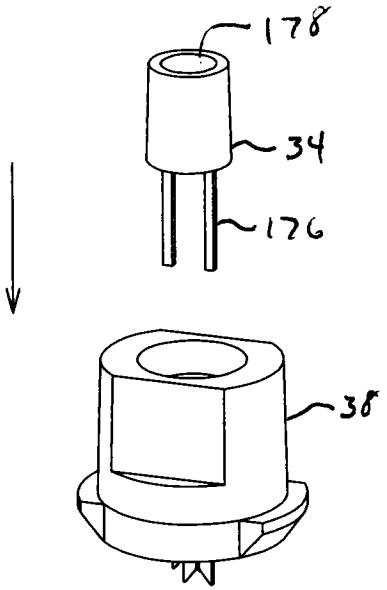
FIG. 7
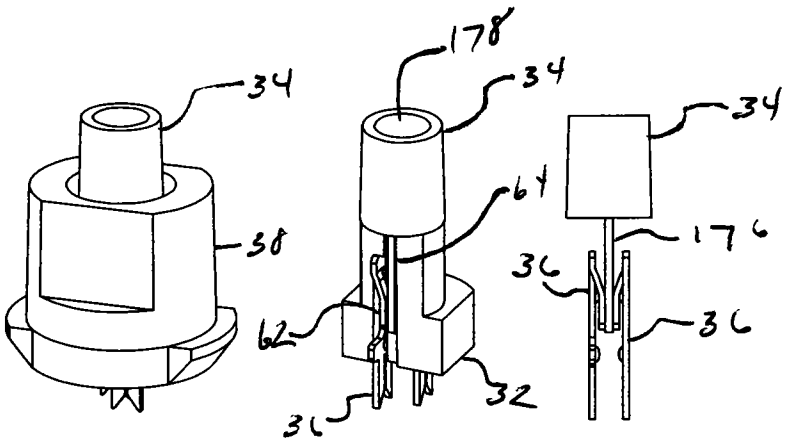
FIG. 8
FIG. 9
FIG. 10

92
94
104

92
94
84

104
92
94
84
88

104
82
94
84
90
92
88
R 32
36
66
68
100

LED LAMP ASSEMBLY AND LIGHT STRINGS INCLUDING A LAMP ASSEMBLY

FIELD OF THE INVENTION

The present invention relates generally to light emitting diode lamps. More particularly, the present invention relates to light emitting diode lamps having housing and conductive structures to make consistent electrical contact with the conductor of a lamp wire.

BACKGROUND OF THE INVENTION

Light emitting diode (LED) lamps provide a source of illumination for a variety of lighting applications including decorative lighting, automotive lighting, architectural lighting and other such applications. In particular, light emitting diodes are more commonly used in decorative Christmas light strings to reduce energy usage and provide pleasing color illumination. For those applications requiring that LED leads be coupled to an insulated conductor, such as in the context of decorative light strings such as those utilized for Christmas decoration, connecting the leads of conventional LED lead frames to wiring poses significant challenges. In some cases, in the prior art, leads are soldered directly to conductors to form a connection. In other circumstances, intermediate conductive structures such as wire terminals or mechanical connectors may be used to form an electrical connection. It can be difficult to make such connections. In particular, it can be difficult to make reliable connections that are consistently electrically and mechanically sound between the LED lead frame and the wiring. Poor connections can lead to lack of illumination, light failure, and can drive up the costs of manufacture and can potentially decrease the safety of the resulting lighting product.

SUMMARY OF THE INVENTION

The present invention solves many of the above problems. An LED lamp assembly of the present invention generally includes an LED insert, an LED, a pair of conductive piercing couplers, an upper housing, a lower housing, an LED cover and two conductor wires.

The LED insert generally houses the two conductive piercing couplers and supports the LED structure. The LED structure extends upwardly from the LED insert and the pair of leads of the LED extends downwardly into the LED insert and makes electrical contact with the upper portion of the conductive piercing couplers. The conductive piercing couplers extend downwardly and outwardly from the LED insert.

The upper housing surrounds the LED insert and defines an upper opening through which the LED structure extends. The LED insert is receivable within the upper housing by being inserted from below into the cavity of the upper housing. When inserted into the upper housing, the conductive piercing couplers extend downwardly from the upper housing.

The upper housing is coupleable to the lower housing, for example, by resilient snap-in type coupler structures. The lower housing includes wire receiving grooves therein through which the two conductor wire may pass.

The cover includes a transparent or translucent structure through which light emitted by the LED passes. The cover may be colorless or act as a color filter while being transparent or translucent. The cover is received within the upper portion of the upper housing and may include a detent groove by which can be secured of the upper housing which has a mating structure to grasp the detent groove. The two conductor wire passes through the groove-receiving portion of the lower housing. The lower housing also has a piercing coupler receiving space defined therein. When the upper housing including the LED insert and conductive piercing couplers is assembled to the lower housing, the conductive piercing couplers pierce the insulation of the two conductor wire and each fork-like conductive piercing coupler engages one of the two parallel conductors of the wires. According to another embodiment of the invention, the conductive piercing couplers engage a single-conductor wire at locations separated from each other and the single conductor wire is severed therebetween by a severing structure thus creating a series connection to a single conductor wire.

According to an example embodiment of the invention, the two conductive piercing couplers are similar in structure. The conductive piercing structure generally includes a fork portion, an insert engaging portion and a wire-receiving slot. The fork portion generally includes two piercing legs separated by a wire-receiving slot. The insert engaging portion generally includes one or more detents structured to engage alignment structures of the LED insert. The wire-receiving slot is resilient and extends outwardly away from the insert engaging portion. The spring-conductor portion is adapted to make contact with a lead of the LED structure. In another example embodiment the fork portion may be replaced by a spear portion piercing member that is adapted to pierce the insulation and to engage the conductor of the wire.

The invention also includes a decorative light string including a plurality of LED lamp assemblies as described herein coupled to a length of wire conductor also having at least one plug or receptacle coupled to the conductors. Another embodiment of the invention includes a method of manufacturing a decorative light string including a plurality of LED lamp assemblies as discussed above and elsewhere in this application.

BRIEF DESCRIPTION OF THE DRAWINGS

FIG. 7 is an exploded perspective view of a LED and upper housing and a LED insert;

FIG. 8 is a perspective view of an assembled LED insert and upper housing;

FIG. 9 is a partial cutaway view of a LED insert and LED lamp as assembled;

FIG. 10 is a sectional view of a LED insert and conductive piercing couplers according to an embodiment of the invention;

DETAILED DESCRIPTION

Figure 1:
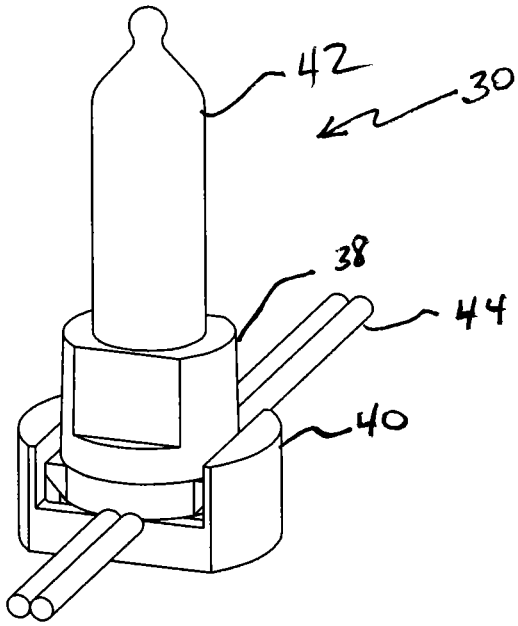
FIG. 1 is a perspective view of a LED lamp assembly and conductors according to an example embodiment of the invention.

Referring to FIGS. 1-29, LED lamp assembly 30 generally includes LED insert 32, LED lamp 34, conductive piercing couplers 36, upper housing 38, lower housing 40, cover 42 and two conductor wire 44.

Referring to particularly to FIGS. 2-4 and FIGS. 20-24, LED insert 32 includes body 46 generally including cylindrical portion 48 and base 50. Body 46 further defines coupler passages 52 extending through body 46 from top 54 to bottom 56 thereof. According to the depicted embodiment, base 50 defines two curved walls 58 and flats 60. Base 50 is shaped to act as an alignment structure when coupled with a complementary structure. LED insert 32 may be formed of a polymer such as polybutylene terephthalate (PBT), having Rockwell hardness, for example, of 121 R. According to an example embodiment, the invention LED insert 32 is formed of a more rigid material relative to upper housing 38 and lower housing 40 which are formed from more flexible material, for example, a polypropylene (PP) material, having a Rockwell hardness, for example, of 95 R, and as discussed further herein. However, it will be understood that materials of the same hardness may be used for both insert 32 and housings 38 and 40, or materials having differing hardnesses, but not comprising PBT and PP, may also be used. In other words, though advantages in using materials of differing hardnesses are described herein, embodiments of the present invention are not limited to the specific example materials described herein.

Figures 20, 21, 22, 23, 24:
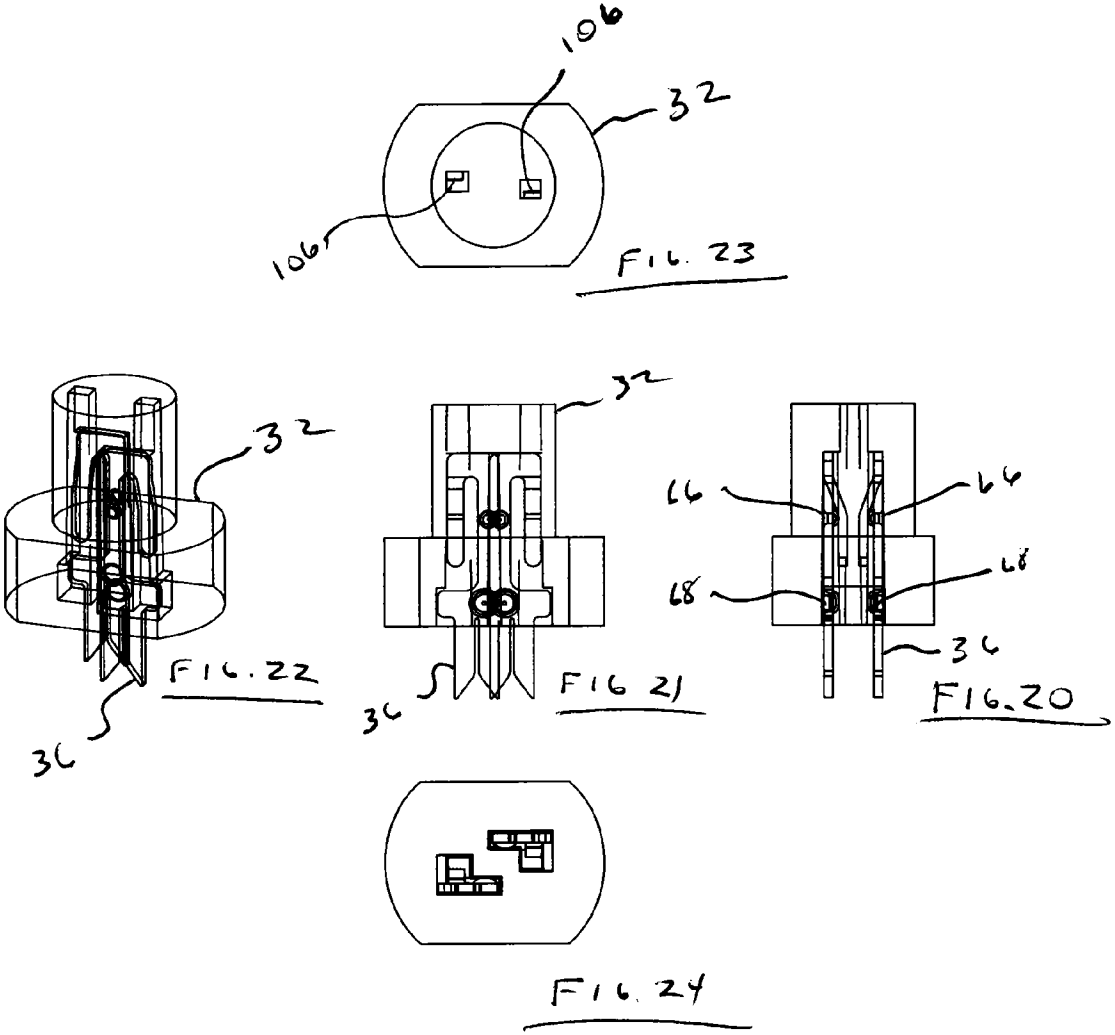
FIG. 20 is a sectional view of the conductive piercing coupler and a LED insert.
FIG. 21 is another sectional view of the conductive piercing coupler and the LED insert.
FIG. 22 is phantom perspective view of the conductive piercing coupler within the LED insert.
FIG. 23 is a plan view of the LED insert and conductive piercing coupler.
FIG. 24 is a bottom view of the LED insert and conductive piercing coupler.
Figure 25:
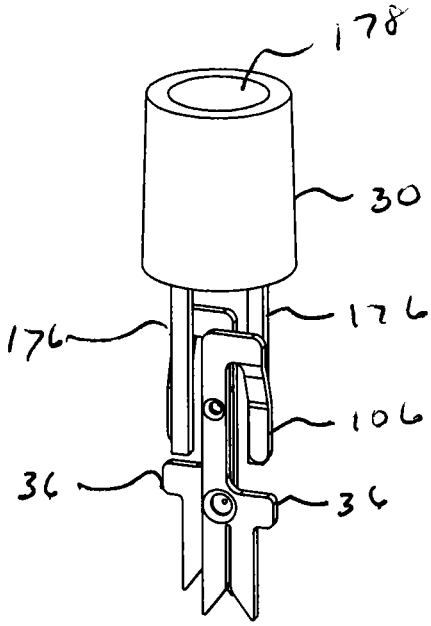
FIG. 25 is a perspective view of a LED in contact with conductive piercing couplers with the LED insert not shown for clarity.
Figure 26:
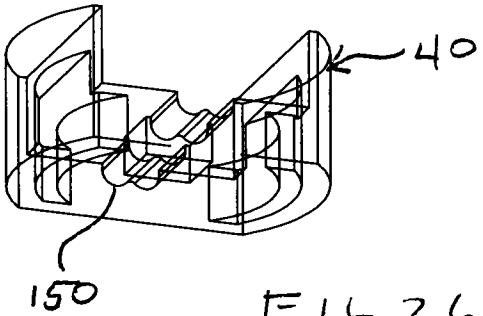
FIG. 26 is a perspective phantom view of a lower housing.
Figure 27:
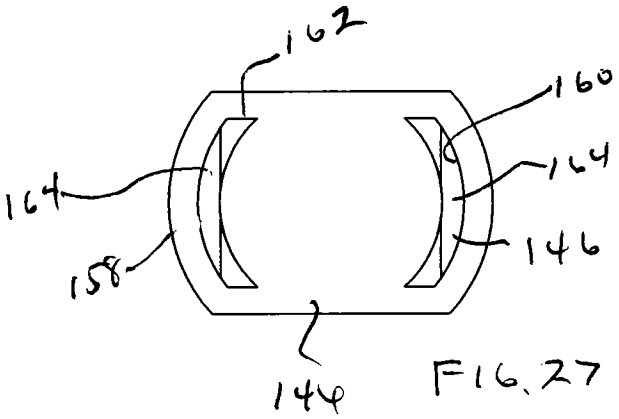
FIG. 27 is a bottom view of the lower housing.

Referring particularly to FIGS. 20-22, coupler passages 52 define conductor-receiving portion 62 and lead-receiving portion 64.

Referring particularly to FIGS. 20 and 21, LED insert 32 presents upper positioning peg 66 and lower positioning peg 68 extending into coupler passages 52. Coupler passages 52 also define L-shaped shoulder portion 70.

Referring particularly to FIG. 23, in one example embodiment conductor receiving portion 62 has a generally square cross section.

LED insert 32 further presents top plane 72, bottom plane 74 and plateau 76.

Referring to FIGS. 16-19, an example embodiment of conductive piercing couplers 36 is depicted. In the depicted embodiment, conductive piercing couplers 36 generally include insulation-piercing and conductor-engaging portion 77. In this example embodiment, insulation piercing and conductor-engaging portion 77 is represented by fork portion 78. The embodiment also includes, insert engaging portion 80 and wire-receiving slot 82. Conductive piercing couplers 36 according to this example embodiment, are formed of a single piece of highly conductive metallic material such as copper, copper alloy or other such conductive metallic material. Conductive piercing couplers 36 may be formed, for example, by stamping and forming.

Fork portion 78 generally includes two piercing legs 84 defining wire-receiving slot 86 therebetween. Each of piercing legs 84 presents beveled end 88. Beveled ends 88 face each other creating funnel shaped entrance 90. The width of wire-receiving slot 84 may be adjusted by those of ordinary skill in the art to properly accommodate the conductor of two conductor wire 44 or other wire having a single conductor or a plurality of conductors. Insulation piercing and conductor engaging portion 77 may also include a single piercing leg 84.

Insert engaging portion 80 of conductive piercing couplers 36 is generally formed of a thin planar sheet of conductive material and presents upper detent 92, lower detent 94 and protruding shoulder 96. Shoulder 96 is bounded by shoulder shelf 98, shoulder overhang 100 and shoulder face 102.

Wire-receiving slot 82 of conductive piercing couplers 36 is generally parallel to insert engaging portion 80 and offset somewhat therefrom. Wire-receiving slot 82 generally presents hook portion 104, offset portion 106 and angled portion 108. The material of which conductive piercing couplers 36 is formed has sufficient resiliency that offset portion 106 is biased generally away from insert engaging portion 80. Offset portion 106 may present rounded end 110.

Referring particularly to FIGS. 5-8, 11 and 12, in this example embodiment, upper housing 38 is a unitary molded structure which can be formed of non-conductive material such as a polymer. In particular, in one example embodiment, upper housing 38 may be formed of polypropylene (PP) or polyethylene (PE). Upper housing 38 may be molded, for example by injection molding. Upper housing 38 has a generally cylindrical structure having a generally cylindrical passageway centrally located therethrough. The exterior of upper housing 38 generally presents cylindrical portion 112, beveled interrupted flange 114, flats 116, upper face 118 and lower face 120. Beveled interrupted flange 114, as depicted, includes two flange segments 122 offset approximately 180° from each other according to the depicted example embodiment. Other arrangements and numbers of flange segments 122 are also within the scope of the invention. Each of flange segments 122 presents perpendicular surface 124 and beveled surface 126. Flange segments 122 also present chamfer 128 between perpendicular surface 124 and beveled surface 126.

Flats 116, in this example embodiment, are located approximately 180° apart relative to cylindrical portion 112 and have faces that are generally parallel.

Figure 12:
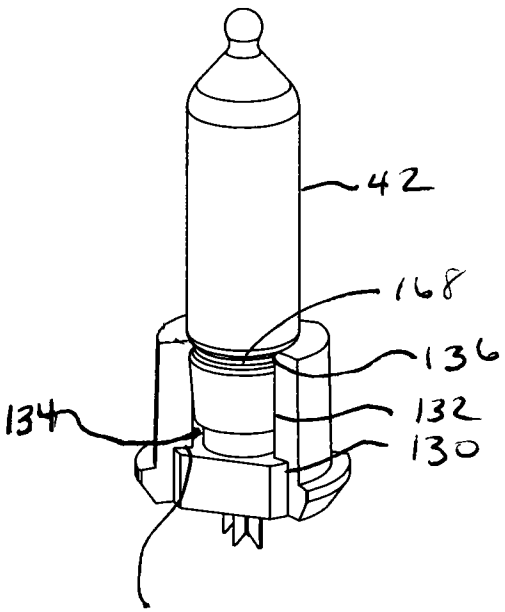
FIG. 12 is a partial cutaway view of an assembled cover, LED insert and upper housing according to an embodiment of the invention.

Referring particularly to FIG. 12, the interior of upper housing 38, generally defines lower portion 130 and upper portion 132. Lower portion 130 is shaped so as to generally conform to base 50 of LED insert 32. Upper portion 132 presents cylindrical walls 134 and annular ring 136. Cylindrical walls 134 and annular ring 136 are dimensioned to receive cover 42 partially therein. Lower portion 130 and upper portion 132 meet and are divided by step 138.

Referring particularly to FIGS. 1 and 13-15, lower housing 40 is a unitary structure which can be formed from a polymer such as polypropylene (PP) or polyethylene (PE). Lower housing 38 generally presents central base 140 and arcuate portions 142. Arcuate portions 142 are located generally 180° apart and are substantially mirrored images of each other in the depicted embodiment.

Central base 140 is generally flat and arcuate portions 142 extend upwardly therefrom. Lower housing 40 present a generally planar bottom surface 144. Bottom surface 144 presents two arc shaped passages 146 extending therethrough. Upper surface 148 of central base 140 presents wire grooves 150 and rectangular recess 152 defined in plateau 154. Rectangular recess 152 is generally centrally located in central base 140. Wire grooves 150, in the depicted example embodiment, are generally parallel and of equal size and shape. While two wire grooves are depicted a single wire groove 150 or multiple wire grooves 150 are also within the scope of the invention. Wire grooves 150 as depicted, generally are mirror images of each other. Rectangular recess 152 is centrally located and depressed into upper surface 148 of central base 140 to a greater degree than wire grooves 150.

Central base 140 is generally bounded by arcuate walls 156 which bound arch-shaped passages 146. Arcuate portions 142 extend generally above upper surface 148 of central base 140. Arcuate portions 142 present convex outer wall 158 and concave inner wall 160. Concave inner wall 160 along with short walls 162 and arcuate walls 156 border on and define arc shaped passages 146. Concave inner wall 160 also extends upwardly above upper surface 148 of central base 140. Arcuate portions 142 also present upper wall 164. Thus, arcuate portions 142 present inward facing openings 166 facing inwardly toward central base 140.

Figure 11:
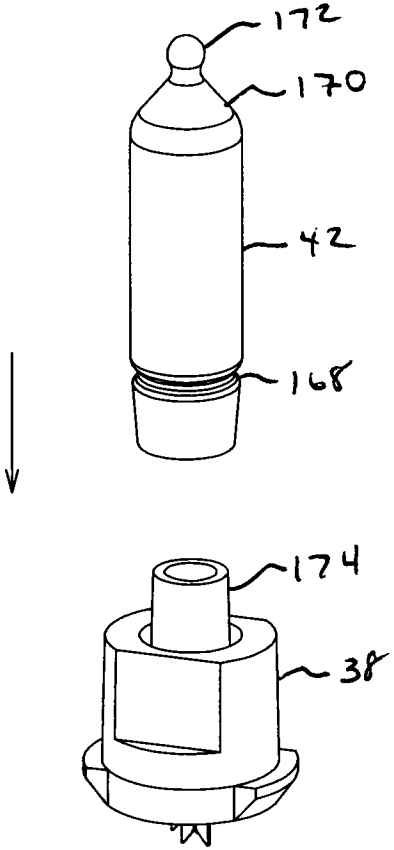
FIG. 11 is an exploded perspective view of an upper housing, LED insert, LED and cover according to an embodiment of the invention.
Figure 14:
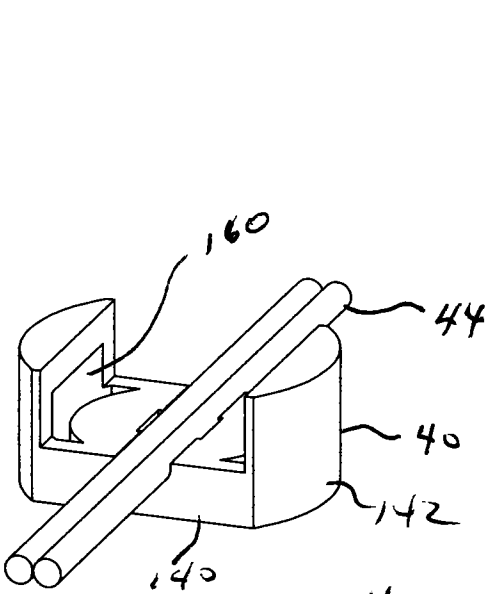
FIG. 14 is assembled perspective view of the lower housing and two conductive wire.
Figure 13:
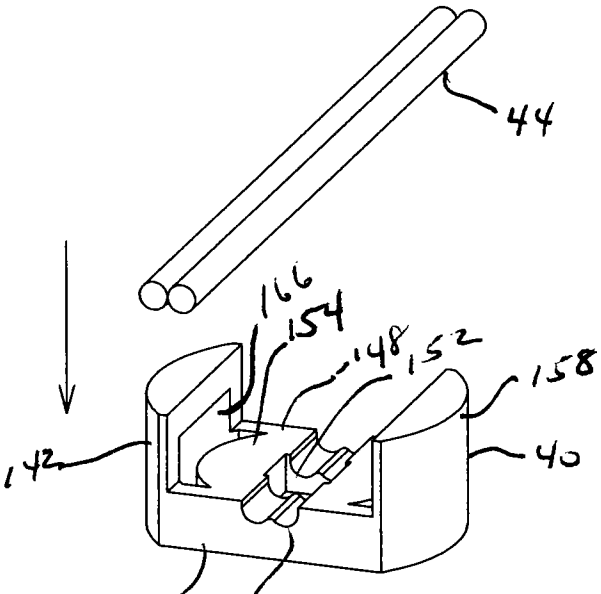
FIG. 13 is an exploded perspective view of a lower housing and two conductor wire.
Figure 15:
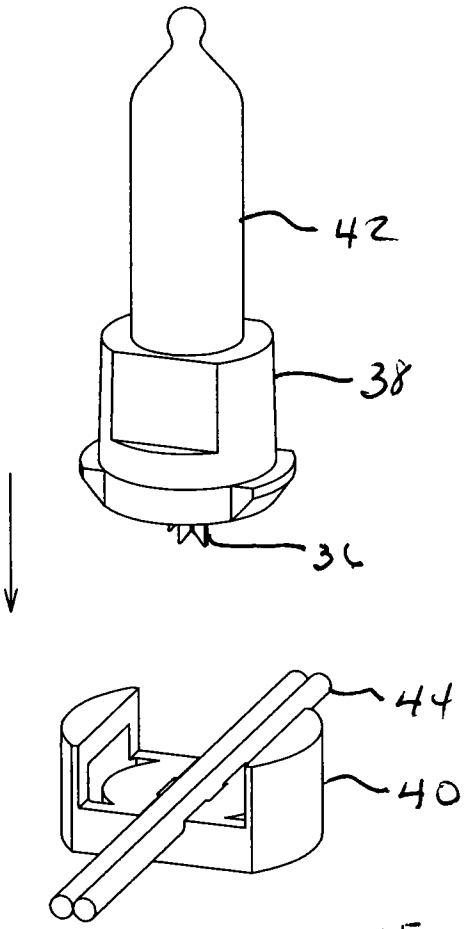
FIG. 15 is an exploded perspective view of the upper and lower housing according to an embodiment of the invention.
Figures 16, 17, 18, 19:
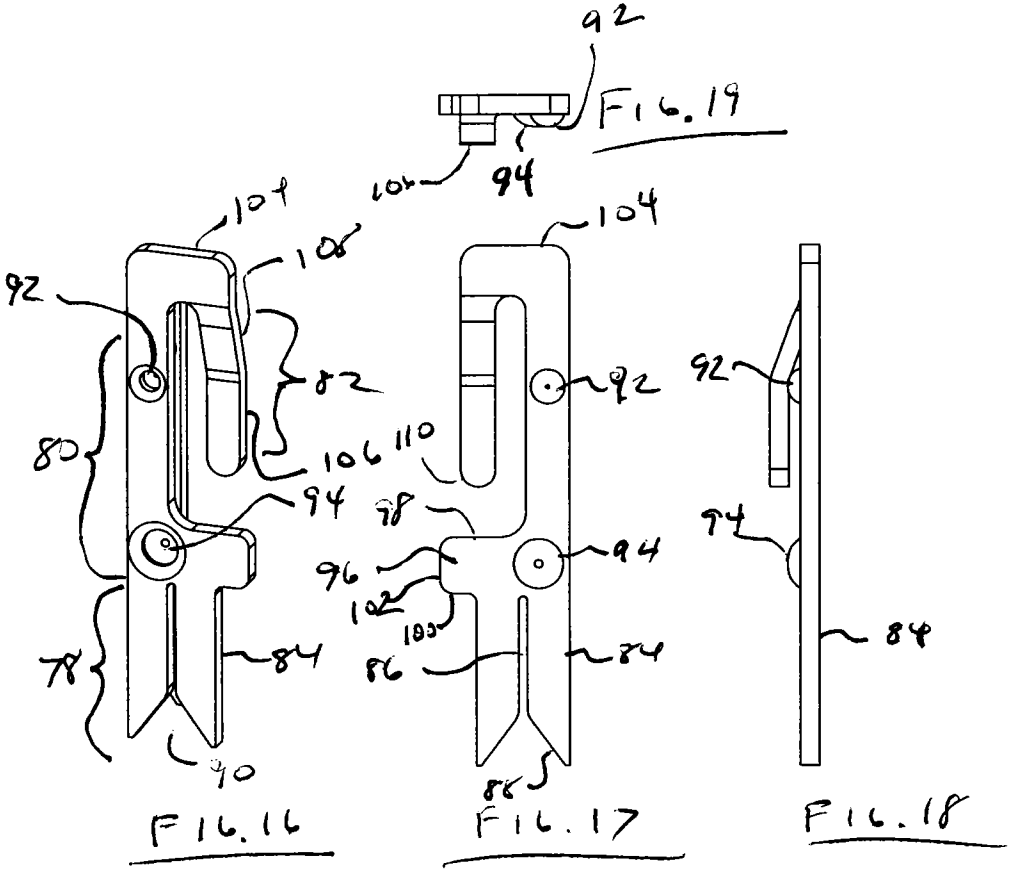
FIG. 16 is a perspective view of a conductive piercing coupler according to an embodiment of the invention.
FIG. 17 is a front elevational view of a conductive piercing coupler.
FIG. 18 is a side elevational view of the conductive piercing coupler.
FIG. 19 is a plan view of the conductive piercing coupler.

Referring to particularly to FIGS. 11, 12 and 15, in some embodiments, LED lamp assembly 30 may include cover 42. Cover 42 comprises a hollow generally cylindrical structure. Cover 42 is closed at a top end thereof and, in the depicted embodiment, generally presents the appearance of a traditional mini Christmas light envelope. Cover 42 generally presents annular detent 168, proximal a lower end thereof and conical top 170 proximal an upper end thereof. Cover 42 also may present knob 172 as depicted. Cover 42 is dimensioned to fit within upper portion 132 of upper housing 38. Annular detent 168 is dimensioned to receive annular ring 136 therein in an interference fit. This description of cover 42 should not be considered limiting as cover 42 may take any desired shape that can be received within upper housing 38. Further, the locations of annular detent 168 and annular ring 136 can be reversed. Cover 42 is formed of a translucent or transparent material and may be colorless or may be formed of a colored material to act as a color filter for light passing through it.

In other embodiments, LED lamp assembly 30 may not include over 42. For such embodiments, LED lamp 34 may extend above upper face 118.

Referring particularly to FIG. 15, two conductor wire 44 is generally conventional in design and may include stranded or solid conductive wire formed of, for example, copper.

LED lamp 34 is a generally conventional LED lamp including leads 176 and lens 178. LED lamp 174 includes an LED chip (not shown). LED leads 176 extend generally downwardly in a parallel fashion from lens 178 in this example embodiment.

Figure 2:
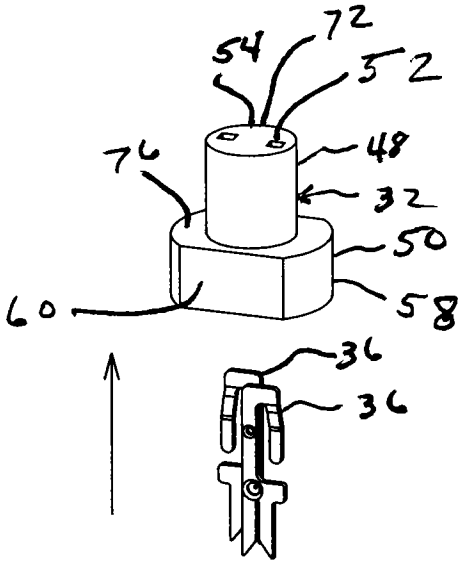
FIG. 2 is an exploded perspective view of a LED insert and conductive piercing couplers according to an embodiment of the invention.
Figure 3:
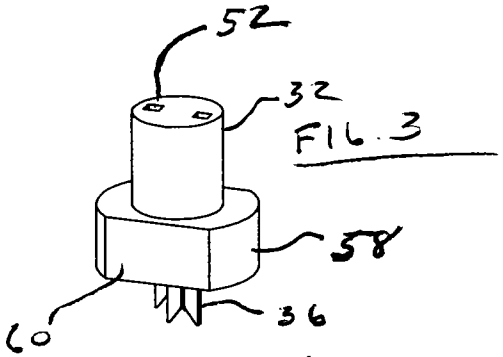
FIG. 3 is a perspective view of the assembled LED insert and conductive piercing couplers.
Figure 4:
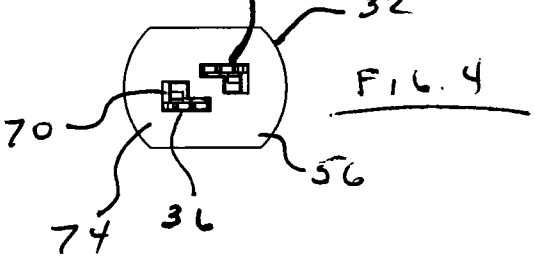
FIG. 4 is a bottom view of the LED insert and conductive piercing couplers of FIG. 3.
Figure 6:
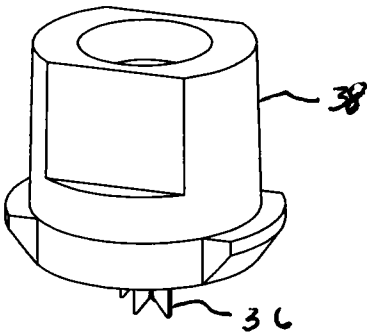
FIG. 6 is perspective view of an assembled LED insert and upper housing.

In operation, LED lamp assembly 30 is assembled as follows:

Referring to FIG. 2, conductive piecing couplers 36 are inserted into LED insert 32 from the bottom of LED insert 32. Upon being received in coupler passages 52, upper positioning peg 66 and lower positioning peg 68 engage upper detent 92 and lower detent 94. Shoulder 96 contacts L-shaped shoulder portion 70 thus preventing conductive piecing couplers 36 from being inserted to far into LED insert 32. The engagement of upper positioning peg 66 with upper detent 92 and the engagement of lower positioning peg 68 with lower detent 94 secures conductive piecing couplers 36 within LED insert 32.

Referring particularly to FIGS. 20, 23 and 24, wire-receiving slot 82 is biased against lead receiving portion 64 of couple passage 52.

Figure 5:
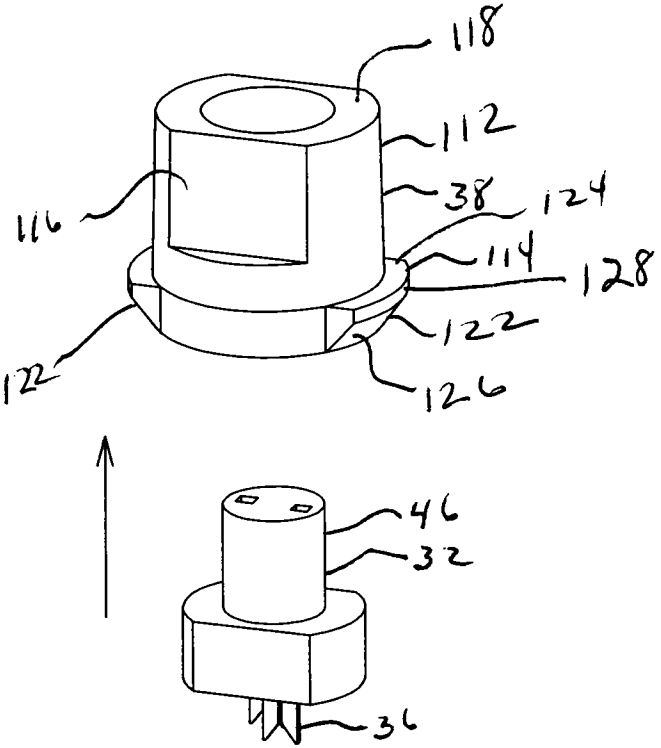
FIG. 5 is an exploded perspective view of a LED insert and upper housing according to an embodiment of the invention.

Referring particularly to FIG. 5, assembled LED insert 32 and conductive piecing couplers 36 are inserted into upper housing 38. As described above, LED insert 32 in an embodiment comprises a material that is somewhat more rigid, or harder, than housing 38. In an embodiment, LED insert 32 comprises a PBT material having a Rockwell hardness of 121 R, while upper housing 38 and lower housing 40 comprise a softer material, PP, having a Rockwell hardness of 95 R. The use of a relatively harder material, PBT, for LED insert 32, as compared to upper housing 38, may be advantageous for securing LED insert 32 with its piercing couplers 36 within upper housing 38. When the fit between insert 32 and housing 38 is fairly tight, the PP material of housing 38 may compress when PBT insert 32 is inserted into housing 38, thereby creating a tight compression and friction fit between the insert and the housing. Further, the harder PBT material of insert 32 ensures less movement of piercing couplers 36, which as described further below assists with proper alignment with wires of a light set.

Figure 28:
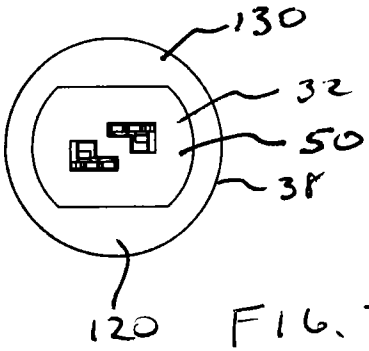
FIG. 28 is a bottom view of the lower housing and an LED insert inserted in the lower housing.

Base 50 engages lower portion 130 of upper housing 38 as depicted in FIG. 28. Lower portion 130 of upper housing 38 is shaped to conform to base 50 of LED insert 32 and to receive flats 60 therein thus creating consistent orientation of LED insert 32 in relation to upper housing 38.

Referring particularly to FIGS. 7-10, leads 176 of LED lamp 174 are inserted into LED insert 32. Leads 176 of LED lamp 174 pass into lead receiving portion 64 such that wire-receiving slot 82 makes electrical contact with leads 176 because of the bias of wire-receiving slot 82 toward the interior of lead receiving portion 164. The engagement of leads 176 with wire-receiving slots 82 are depicted in FIGS. 9 and 10.

As depicted in FIGS. 11 and 12, cover 42, when used, is inserted into upper portion 132 of upper housing 38. Because of the resilicency of upper housing 38, and the relative stiffness of cover 42, cover 42 can be inserted therein until annular detent 168 engages annular ring 136, thus securing cover 42 within upper housing 38. Light from LED lamp 174 passes through cover 42.

Referring to FIGS. 1 and 15, two conductor wire 44, or a pair of single wires, is inserted into wire grooves 150 of lower housing 40. Only a single conductor wire can be present in the case of a series wiring. More than two conductors may be present as well, for example in flashing or chasing light arrangements.

Upper housing 38 and lower housing 40 are assembled by pressing or snapping them together. Beveled interrupted flanges 114 are received into inward facing openings 166 of arcuate portions 142. Because of the resiliency of the PP material of lower housing 40, lower housing 40 flexes to receive upper housing such that upper wall 164 of arcuate portions 142 engages perpendicular surface 124 of beveled interrupted flanges 114 thus securing upper housing 38 to lower housing 40.

Figure 29:
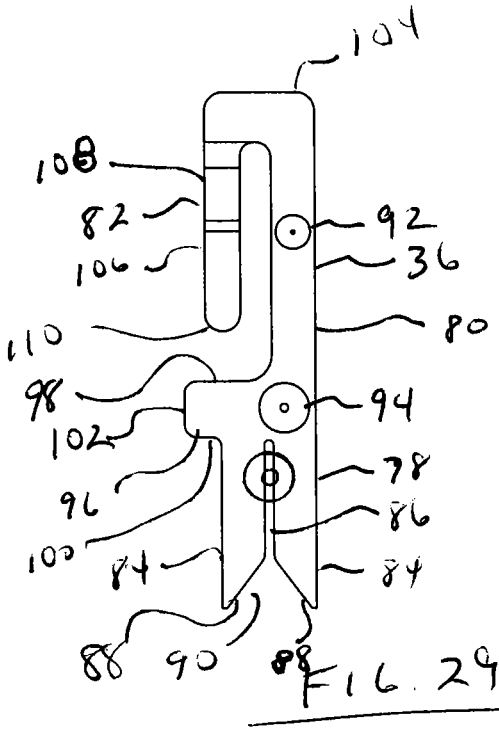
FIG. 29 is a sectional view of conductive piercing coupler engaged to a conductor of an insulated wire.

At the same time, each wire of two conductor wire 44 is received into funnel shaped entrance 90 of wire-receiving slot 86 of fork portion 78 of conductive piercing couplers 36 as depicted in FIG. 29. Each of piercing legs 84 displaces and pierces the insulation of two conductor wire 44 and the conductors of two conductor wire 44 pass through funnel shaped entrance 90 into wire-receiving slot 86. Wire-receiving slot 86 is sized to be somewhat smaller than the diameter of the conductors of two conductor wire 44, thus indenting and deforming the conductors of two conductor wire 44 to create a tight reliable electrical connection. The use of a relatively hard material, such as PBT, for insert 32, decreases deformation of insert 32, thusly holding each of piercing legs 84 in a relatively constant position with respect to insert 32 as the insulation of wire 44 is pierced. Use of a softer insert 32 material, such as PP, would allow more deformation of insert 32, and more movement of piecing legs 84 during the piercing process. The portion of piercing legs 84 that extends beyond two conductor wire 44 is received into rectangular recess 152 and may pierce lower housing 40, which in an embodiment comprises a PP material, to some degree. A complete LED lamp assembly 30 is depicted in FIG. 1.

The invention also includes a decorative string of lights including a plurality of LED lamp assemblies 30 assembled along the length of two conductor wire 44. The invention also includes a method of assembling LED lamp assemblies 30 to two conductor wire 44 or to wire having a single conductor or more conductors.

The invention may be embodied in other specific forms without departing from the spirit of the essential attributes thereof, therefore, the illustrated embodiments should be considered in all respects as illustrative and not restrictive, reference being made to the appended claims rather than to the forgoing description to indicate the scope of the invention.

The invention claimed is:

1. An LED lamp assembly, comprising:

an LED lamp having a lens portion and two leads, each of the two leads extending outwardly away from the lens portion;

an LED insert having a body defining two coupler passages extending therethough from a top to a bottom thereof;

two conductive piercing couplers, each of the conductive piercing couplers including an insulation piercing wire engaging portion, an insert engaging portion and a spring contact portion, the insulation piercing wire engaging portion presenting a first piercing leg extending downwardly from the insert engaging portion, the insert engaging portion being engaged in one of the two coupler passages of the LED insert and the spring contact portion being resiliently biased toward a lead receiving portion of the LED insert;

an upper housing at least partially surrounding the LED insert and receiving the LED insert therein in close fitting apposition and including at least one lower housing engagement structure;

a lower housing presenting at least one upper housing engagement structure that engages the lower housing engagement structure of the upper housing such that the upper housing and the lower housing are secured to each other, the lower housing further presenting a wire receiving space therein, the wire receiving space being structured and positioned to be aligned with the insulation piercing wire engaging portion of the two conductive piercing couplers when the upper housing is secured to the lower housing;

wherein the two leads of the LED lamp are positioned each in one of the two coupler passages and each of the two leads is held in secure electrically conductive and mechanical contact with one of the spring contact portions of the two conductive piercing couplers.

2. The LED lamp assembly as claimed in claim 1, wherein each of the conductive piercing couplers further comprises a second piercing leg, the first piercing leg and the second piercing leg being oriented to define a wire-receiving slot between the first piercing leg and the second piercing leg.

3. The LED lamp assembly as claimed in claim 1, further comprising a transparent or translucent cover engageable with the upper housing and enclosing the LED lamp therein.

4. The LED lamp assembly as claimed in claim 1, further wherein the LED insert is formed of a first material having greater rigidity than either a second material of the upper housing or a third material of the lower housing.

5. The LED lamp assembly as claimed in claim 1, wherein the LED insert further comprises a first alignment structure that mates with a complementary second alignment structure of one of the upper and lower housing whereby the LED insert is oriented relative to the wire receiving space.

6. The LED lamp assembly as claimed in claim 1, further comprising a two conductor wire having a first conductor and a second conductor and wherein the two conductive piercing couplers each establish electrically conductive and mechanical contact with one of the first conductor and the second conductor establishing a parallel wiring arrangement.

7. The LED lamp assembly as claimed in claim 1, further comprising a wire having a single conductor and wherein the two conductive piercing couplers both establish electrically conductive and mechanical contact with the single conductor and the single conductor is severed between the two conductive piercing couplers establishing a series wiring arrangement.

8. An LED lamp assembly, comprising:

an LED lamp having a lens portion and two leads, each of the two leads extending outwardly away from the lens portion;

an LED insert having a body defining two coupler passages extending therethough from a top to a bottom thereof;

two conductive piercing couplers, each of the conductive piercing couplers being engaged in one of the two coupler passages of the LED insert;

an upper housing at least partially surrounding the LED insert and receiving the LED insert therein;

a lower housing that engages the upper housing such that the upper housing and the lower housing are secured to each other;

wherein the LED insert is formed of a first material having greater rigidity than either a second material of the upper housing or a third material of the lower housing.

9. The LED lamp assembly as claimed in claim 8, wherein the first material comprises polybutylene terephthalate (PBT).

10. The LED lamp assembly as claimed in claim 8, wherein the second material and the third material are the same material.

11. The LED lamp assembly as claimed in claim 8, wherein the second material comprises polypropylene.

12. The LED lamp assembly as claimed in claim 8, wherein the third material comprises polypropylene.

13. A decorative light string, comprising:

a wire including a first conductor and insulation;

a plurality of LED lamp assemblies, at least one of the LED lamp assemblies comprising:

an LED lamp having a lens portion and two leads, each of the two leads extending outwardly away from the lens portion;

an LED insert having a body defining two coupler passages extending therethough from a top to a bottom thereof;

two conductive piercing couplers, each of the conductive piercing couplers including an insulation-piercing wire-engaging portion piercing the insulation and engaged to the conductor, an insert engaging portion and a spring contact portion, the insulation piercing wire engaging portion presenting a first piercing leg extending downwardly from the insert engaging portion, the insert engaging portion being engaged in one of the two coupler passages of the LED insert and the spring contact portion being resiliently biased toward a lead receiving portion of the LED insert;

an upper housing at least partially surrounding the LED insert and receiving the LED insert therein in close fitting apposition and including at least one lower housing engagement structure;

a lower housing presenting at least one upper housing engagement structure that engages the lower housing engagement structure of the upper housing such that the upper housing and the lower housing are secured to each other, the lower housing further presenting a wire receiving space therein, the wire receiving space being structured and positioned to be aligned with the insulation piercing wire engaging portion of the two conductive piercing couplers when the upper housing is secured to the lower housing;

wherein the two leads of the LED lamp are positioned each in one of the two coupler passages and each of the two leads is held in secure electrically conductive and mechanical contact with one of the spring contact portions of the two conductive piercing couplers.

14. The decorative light string as claimed in claim 13, wherein each of the conductive piercing couplers further comprises a second piercing leg, the first piercing leg and the second piercing leg being oriented to define a wire-receiving slot between the first piercing leg and the second piercing leg and the first conductor being engaged in one of the wire-receiving slots.

15. The decorative light string as claimed in claim 14, wherein at least one of the plurality of LED lamp assemblies further comprises a transparent or translucent cover engageable with the upper housing and enclosing the LED lamp therein.

16. The decorative light string as claimed in claim 14, further wherein the LED insert of at least one of the plurality of LED lamp assemblies is formed of a first material having greater rigidity than either a second material of the upper housing or a third material of the lower housing.

17. The decorative light string as claimed in claim 14, further wherein the LED insert of at least one of the plurality of LED lamp assemblies further comprises a first alignment structure that mates with a complementary second alignment structure of one of the upper and lower housing whereby the LED insert is oriented relative to the wire receiving space.

18. The decorative light string as claimed in claim 14, the wire further comprising a second conductor and wherein the two conductive piercing couplers of each LED lamp assembly each establish electrically conductive and mechanical contact with one of the first conductor and the second conductor establishing a parallel wiring arrangement.

19. The decorative light string as claimed in claim 14, wherein the two conductive piercing couplers both establish electrically conductive and mechanical contact with the first conductor and the first conductor is severed between the two conductive piercing couplers establishing a series wiring arrangement.

20. An LED lamp assembly, comprising:

an LED lamp having a lens portion and two leads, including a first lead and a second lead, each of the two leads extending outwardly away from the lens portion, the first lead including a first end distal to the lens and the second lead including a second end distal to the lens;

an LED insert having a body defining two coupler passages, including a first coupler passage and a second coupler passage, extending therethrough;

two conductive couplers, each of the conductive couplers being engaged in one of the two coupler passages of the LED insert, each one of the two conductive couplers being in electrical contact with one of the two leads of the LED lamp;

a housing at least partially surrounding the LED insert and receiving the LED insert therein;

wherein the first end of the first lead is enclosed within the first coupler passage and the second end of the second lead is enclosed within the second coupler passage, such that the first end and the second end do not extend outside the first and second coupler passages, respectively.

21. The LED lamp assembly of claim 20, wherein the LED insert is formed of a first material having greater rigidity than a second material of the housing.

22. The LED lamp assembly of claim 21, wherein the insert material comprises polybutylene teraphthalate and the housing comprises polypropylene.

23. The LED lamp assembly of claim 20, wherein the conductive couplers comprise wire-piercing conductive couplers.

24. An LED lamp assembly, comprising:

an LED lamp having a lens portion, a first lead and a second lead, each of the first and the second leads extending outwardly away from the lens portion;

a housing engaging the LED lamp and defining two coupler passages, including a first coupler passage and a second coupler passage;

a first conductive coupler and a second conductive coupler, a first end of the first conductive coupler being engaged in the first coupler passage of the housing, and a second end of the second conductive coupler being engaged in the second coupler passage of the housing, the first conductive coupler being in electrical contact with the first lead of the LED lamp within the first coupler passage and the second conductive coupler being in electrical contact with the second lead of the LED lamp within the second coupler passage.

25. The LED lamp assembly of claim 24, wherein the first conductive coupler includes a first piercing portion.

26. The LED lamp assembly of claim 25, wherein the first piercing portion comprises a fork portion having two piercing legs and defining a wire-receiving slot.

* * * * *